US012805562B2

(12) United States Patent
Erguven et al.

(10) Patent No.: US 12,805,562 B2
(45) Date of Patent: Nov. 24, 2026

(54) REFILLING DEVICE AND METHOD

(71) Applicant: NICOVENTURES TRADING LIMITED, London (GB)

(72) Inventors: Nejat Erguven, London (GB); Matthew Hodgson, London (GB)

(73) Assignee: NICOVENTURES TRADING LIMITED, London (GB)

( * ) Notice: Subject to any disclaimer, the term of this patent is extended or adjusted under 35 U.S.C. 154(b) by 85 days.

(21) Appl. No.: 18/845,642

(22) PCT Filed: Mar. 15, 2023

(86) PCT No.: PCT/GB2023/050605

§ 371 (c)(1),
(2) Date: Sep. 10, 2024

(87) PCT Pub. No.: WO2023/175323

PCT Pub. Date: Sep. 21, 2023

(65) Prior Publication Data

US 2025/0194669 A1 Jun. 19, 2025

(30) Foreign Application Priority Data

Mar. 16, 2022 (GB) ..... 2203616

(51) Int. Cl.
*A24F 15/015* (2020.01)
*A24F 40/65* (2020.01)

(52) U.S. Cl.
CPC ..... *A24F 15/015* (2020.01); *A24F 40/65* (2020.01)

(58) Field of Classification Search
CPC ..... A24F 15/015; A24F 40/65
See application file for complete search history.

(56) References Cited

U.S. PATENT DOCUMENTS 10,327,479 B2 * 6/2019 Popplewell ..... A24F 40/53
10,881,141 B2 * 1/2021 Fraser ..... H05B 3/46
(Continued)

FOREIGN PATENT DOCUMENTS

EP 3793170 A1 3/2021
EP 3831230 A1 6/2021
(Continued)

OTHER PUBLICATIONS

International Search Report and Written Opinion from corresponding International Application No. PCT/GB2023/050605 mailed Aug. 4, 2023, all pages cited in its entirety.
(Continued)

*Primary Examiner* — Thomas D Alunkal
(74) *Attorney, Agent, or Firm* — Burr & Forman

(57) ABSTRACT

A refilling device for an article of an aerosol provision system comprises a communications interface and control circuitry. The control circuitry is configured to receive a request to locate a lost aerosol provision system, determine an identifier for the lost aerosol provision system, broadcast, via the communications interface, an identification request, receive, from one or more aerosol provision systems via the communications interface, a response comprising an identifier for the aerosol provision system, and determine, by comparing the received identifiers to the identifier for the lost aerosol provision system, whether the lost aerosol provision system is within a broadcast range of the refilling device.

16 Claims, 6 Drawing Sheets

(56) References Cited

U.S. PATENT DOCUMENTS

| | | | | |
|---|---|---|---|---|
| 2016/0366946 | A1* | 12/2016 | Murison | A24B 15/167 |
| 2019/0272359 | A1 | 9/2019 | Popplewell et al. | |
| 2020/0000143 | A1* | 1/2020 | Anderson | G06F 21/32 |
| 2020/0110148 | A1* | 4/2020 | Estripeau | A24F 40/40 |
| 2021/0106774 | A1* | 4/2021 | Ezeoke | A61M 15/06 |
| 2022/0132937 | A1* | 5/2022 | Grobler | A24F 40/53 131/328 |
| 2022/0151288 | A1* | 5/2022 | Moloney | A24D 3/17 |
| 2023/0389601 | A1* | 12/2023 | El-Assaad | A24F 15/015 |
| 2024/0057668 | A1* | 2/2024 | Yamaguchi | A24F 40/46 |

FOREIGN PATENT DOCUMENTS

| | | | |
|---|---|---|---|
| WO | 2019121778 | A1 | 6/2019 |
| WO | 2019162155 | A1 | 8/2019 |

OTHER PUBLICATIONS

Search Report and Opinion from corresponding GB Application No. 2203616.4 dated Dec. 2, 2022, all pages cited in its entirety.

* cited by examiner

REFILLING DEVICE AND METHOD

TECHNICAL FIELD

The present invention relates to a refilling device for an article of an aerosol provision system and a method of locating an aerosol provision system.

BACKGROUND

Electronic aerosol provision systems such as electronic cigarettes (e-cigarettes) generally contain an aerosol-generating material, such as a reservoir of a source liquid containing a formulation, typically including nicotine, or a solid material such as a tobacco-based product, from which an aerosol is generated for inhalation by a user, for example through heat vaporisation. Thus, an aerosol provision system will typically comprise an aerosol generator, e.g. a heating element, arranged to aerosolise a portion of aerosol-generating material to generate an aerosol in an aerosol generation region of an air channel through the aerosol provision system. As a user inhales on the device and electrical power is supplied to the aerosol generator, air is drawn into the device through one or more inlet holes and along the air channel to the aerosol generation region, where the air mixes with the vaporised aerosol generator and forms a condensation aerosol. The air drawn through the aerosol generation region continues along the air channel to a mouthpiece, carrying some of the aerosol with it, and out through the mouthpiece for inhalation by the user.

It is common for aerosol provision systems to comprise a modular assembly, often having two main functional parts, namely an aerosol provision device and an article. Typically the article will comprise the consumable aerosol-generating material and the aerosol generator (heating element), while the aerosol provision device part will comprise longer-life items, such as a rechargeable battery, device control circuitry and user interface features. The aerosol provision device may also be referred to as a reusable part or battery section and the article may also be referred to as a consumable, disposable/replaceable part, cartridge or cartomiser.

The aerosol provision device and article are mechanically coupled together at an interface for use, for example using a screw thread, bayonet, latched or friction fit fixing. When the aerosol-generating material in an article has been exhausted, or the user wishes to switch to a different article having a different aerosol-generating material, the article may be removed from the aerosol provision device and a replacement article may be attached to the device in its place. Alternatively, some articles are configured such that, after the aerosol-generating material in the article has been exhausted, the article can be refilled with more aerosol-generating material, thereby allowing the article to be reused. In this example, the user is able to refill the article using a separate reservoir of aerosol-generating material. The aerosol-generating material used to refill the article may be the same or different to the previous aerosol-generating material in the article, thereby allowing the user to change to a different aerosol-generating material without purchasing a new article.

As the aerosol provision system is a handheld and portable device, the user of the aerosol provision system may drop, misplace or otherwise lose the aerosol provision system. Locating the aerosol provision system can be difficult since as a provision systems are generally small and not all aerosol provision systems have a means of determining their own location.

Various approaches are described herein which seek to help address or mitigate some of the issues discussed above.

SUMMARY

The disclosure is defined in the appended claims.

In accordance with some embodiments described herein, there is provided a refilling device for an article of an aerosol provision system comprising: a communications interface; and control circuitry configured to: receive a request to locate a lost aerosol provision system; determine an identifier for the lost aerosol provision system; broadcast, via the communications interface, an identification request; receive, from one or more aerosol provision systems via the communications interface, a response comprising an identifier for the aerosol provision system; and determine, by comparing the received identifiers to the identifier for the lost aerosol provision system, whether the lost aerosol provision system is within a broadcast range of the refilling device.

The control circuitry can be further configured to determine, based on whether the lost aerosol provision system is within the broadcast range of the refilling device, a location of the lost aerosol provision system.

The control circuitry can be further configured to send, to one or more connected devices via the communications interface, a location request comprising the identifier for the lost aerosol provision system; and receive, from each of the connected devices via the communications interface, an indication whether the lost aerosol provision system is within a broadcast range of the connected device, wherein determining the location of the lost aerosol provision system further based on the indications received from each of the connected devices.

The control circuitry can be further configured to receive, from one or more of the connected devices via the communications interface, location information when the lost aerosol provision system is within the broadcast range of the connected device, the location information comprising the location of the connected device and a distance to the lost aerosol provision system, and wherein determining the location of the lost aerosol provision system further based on the location information. At least one of the connected devices may be another refilling device.

The request to locate the lost aerosol provision system may be received from an external device via the communications interface. The request to locate the lost aerosol provision system may be received using Bluetooth. The control circuitry can be further configured to send, to the external device via the communications interface, an indication of whether the lost aerosol provision system is within a broadcast range of the refilling device.

The refilling device can also comprise an input device and wherein the request to locate the lost aerosol provision system is received via the input device.

The refilling device can also comprise an output device configured to output an indication of the location of the lost aerosol provision system.

The request to locate the lost aerosol provision system can comprise the identifier of the lost aerosol provision system.

The aerosol provision system can be associated with a user account, and the control circuitry can be configured to determine the identifier of the lost aerosol provision system based on information associated with the user account.

In accordance with some embodiments described herein, there is provided a refilling device for an article of an aerosol provision system comprising: a communications interface; and control circuitry configured to: receive, via the communications interface, a location request to locate a lost aerosol provision system from a connected device, the request comprising an identifier for the lost aerosol provision system; broadcast, via the communications interface, an identification request; receive, from one or more aerosol provision systems via the communications interface, a response comprising an identifier for the aerosol provision system; determine, by comparing the received identifiers to the identifier for the lost aerosol provision system, whether the lost aerosol provision system is within a broadcast range of the refilling device; and send, to the connected device via the communications interface, an indication whether the lost aerosol provision system is within the broadcast range of the refilling device based on the determining.

The control circuitry is further configured to send, to the connected device via the communications interface, location information if the lost aerosol provision system is within the broadcast range of the refilling device. Then control circuitry can then be configured to determine a distance to the lost aerosol provision system based on the response received from the lost aerosol provision system, and wherein the location information comprises a location of the refilling device and the distance to the lost aerosol provision system.

In accordance with some embodiments described herein, there is provided a method of locating an aerosol provision system comprising: receiving a request to locate a lost aerosol provision system; determining an identifier for the lost aerosol provision system; broadcasting an identification request; receiving, from one or more aerosol provision systems, a response comprising an identifier for the aerosol provision system; and determining, by comparing the received identifiers to the identifier for the lost aerosol provision system, whether the lost aerosol provision system is within a broadcast range.

In accordance with some embodiments described herein, there is provided a method of locating an aerosol provision system comprising: receiving a location request to locate a lost aerosol provision system from a connected device, the request comprising an identifier for the lost aerosol provision system; broadcasting, an identification request; receiving, from one or more aerosol provision systems, a response comprising an identifier for the aerosol provision system; determining, by comparing the received identifiers to the identifier for the lost aerosol provision system, if the lost aerosol provision system is within a broadcast range; and sending, to the connected device, an indication whether the lost aerosol provision system is within the broadcast range based on the determining.

There is also provided a computer readable storage medium comprising instructions which, when executed by a processor, performs one or more of the above methods.

These aspects and other aspects will be apparent from the following detailed description. In this regard, particular sections of the description are not to be read in isolation from other sections.

BRIEF DESCRIPTION OF DRAWINGS

Embodiments of the invention will now be described, by way of example only, with reference to accompanying drawings, in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of articles and systems discussed herein which are not described in detail may be implemented in accordance with any conventional techniques for implementing such aspects and features.

The present disclosure relates to aerosol provision systems, which may also be referred to as vapour provision systems, such as e-cigarettes. Throughout the following description the term "e-cigarette" or "electronic cigarette" may sometimes be used, but it will be appreciated this term may be used interchangeably with aerosol provision system and electronic aerosol provision system.

As noted above, aerosol provision systems (e-cigarettes) often comprise a modular assembly including both a reusable part (aerosol provision device) and a replaceable (disposable) or refillable cartridge part, referred to as an article. Systems conforming to this type of two-part modular configuration may generally be referred to as two-part systems or devices. It is also common for electronic cigarettes to have a generally elongate shape. For the sake of providing a concrete example, certain embodiments of the disclosure described herein comprise this kind of generally elongate two-part system employing refillable cartridges. However, it will be appreciated the underlying principles described herein may equally be adopted for other electronic cigarette configurations, for example modular systems comprising more than two parts, as devices conforming to other overall shapes, for example based on so-called box-mod high performance devices that typically have a more boxy shape, or even systems comprising one part where the aerosol provision device and article are integrally formed with one another.

As described above, the present disclosure relates to (but it not limited to) refilling devices for articles of aerosol provision systems, such as e-cigarettes and electronic cigarettes.

Figure 1:
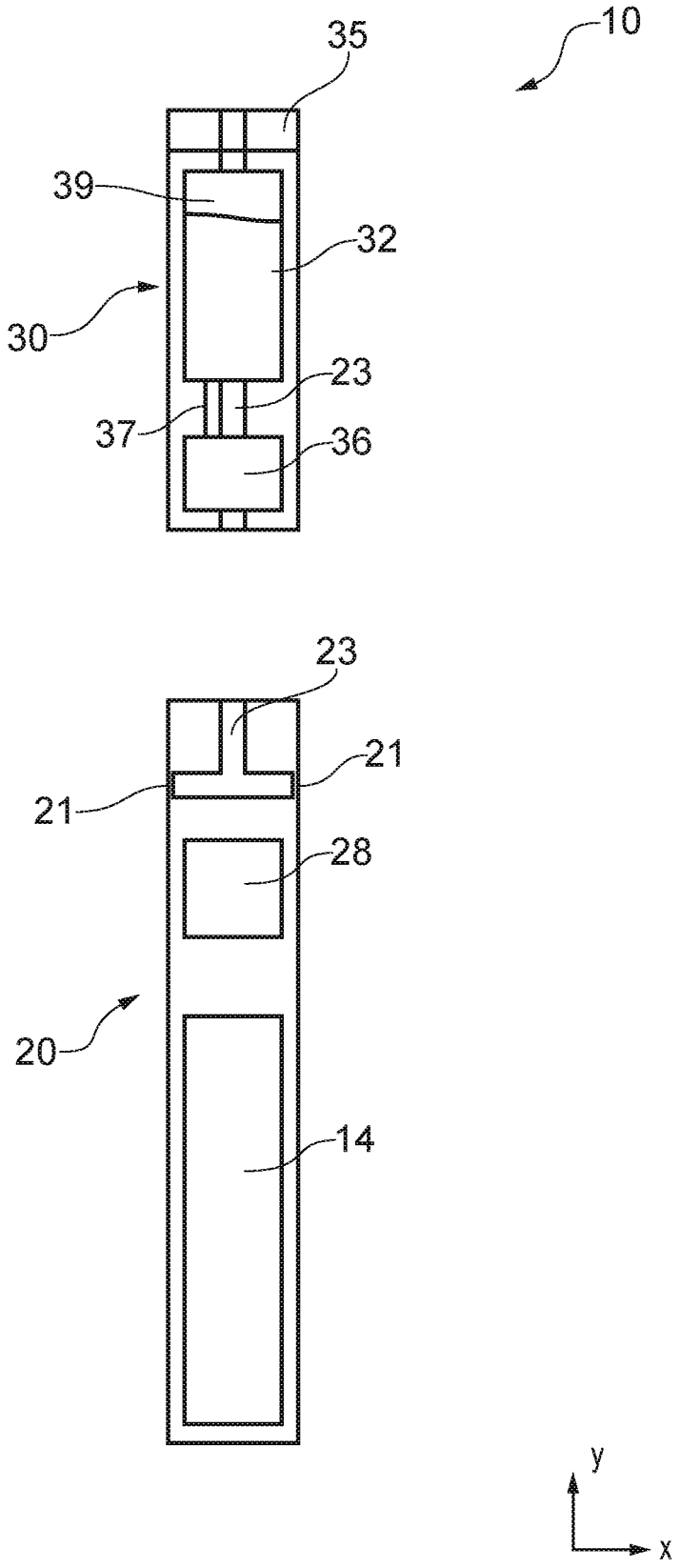
FIG. 1 is a schematic diagram of an aerosol provision system.

FIG. 1 is a highly schematic diagram (not to scale) of an example aerosol provision system 10, such as an e-cigarette, to which embodiments are applicable. The aerosol provision system 10 has a generally cylindrical shape, extending along a longitudinal or y axis as indicated by the axes (although aspects of the invention are applicable to e-cigarettes configured in other shapes and arrangements), and comprises two main components, namely an aerosol provision device 20 and an article 30.

The article 30 comprises or consists of aerosol-generating material 32, part or all of which is intended to be consumed during use by a user. An article 30 may comprise one or more other components, such as an aerosol-generating material storage area 39, an aerosol-generating material transfer component 37, an aerosol generation area, a housing, a wrapper, a mouthpiece 35, a filter and/or an aerosol-modifying agent.

An article 30 may also comprise an aerosol generator 36, such as a heating element, that emits heat to cause the aerosol-generating material 32 to generate aerosol in use. The aerosol generator 36 may, for example, comprise combustible material, a material heatable by electrical conduction, or a susceptor. It should be noted that it is possible for the aerosol generator 36 to be part of the aerosol provision device 20 and the article 30 then may comprise the aerosol-generating material storage area 39 for the aerosol-generating material 32 such that, when the article 30 is coupled with the aerosol provision device 20, the aerosol-generating material 32 can be transferred to the aerosol generator 36 in the aerosol provision device 20. It should be appreciated that the aerosol generator 36 may encompass an aerosol generator other than a heater. More generally, an aerosol generator is an apparatus configured to cause aerosol to be generated from the aerosol-generating material. In some other embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

Aerosol-generating material is a material that is capable of generating aerosol, for example when heated, irradiated or energized in any other way. The aerosol-generating material 32 may, for example, be in the form of a solid, liquid or gel which may or may not contain an active substance and/or flavourants. In some embodiments, the aerosol-generating material 32 may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material 32 may for example comprise from about 50 wt %, 60 wt % or 70 wt % of amorphous solid, to about 90 wt %, 95 wt % or 100 wt % of amorphous solid.

The aerosol-generating material comprises one or more ingredients, such as one or more active substances and/or flavourants, one or more aerosol-former materials, and optionally one or more other functional materials such as pH regulators, colouring agents, preservatives, binders, fillers, stabilizers, and/or antioxidants.

The active substance as used herein may be a physiologically active material, which is a material intended to achieve or enhance a physiological response. The active substance may for example be selected from nutraceuticals, nootropics, and psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

The aerosol provision device 20 includes a power source 14, such as a battery, configured to supply electrical power to the aerosol generator 36. The power source 14 in this example is rechargeable and may be of a conventional type, for example of the kind normally used in electronic cigarettes and other applications requiring provision of relatively high currents over relatively short periods. The battery 14 may be recharged through the charging port (not illustrated), which may, for example, comprise a USB connector.

The aerosol provision device 20 includes device control circuitry 28 configured to control the operation of the aerosol provision system 10 and provide conventional operating functions in line with the established techniques for controlling aerosol provision systems such as electronic cigarettes. The device control circuitry (processor circuitry) 28 may be considered to logically comprise various sub-units/circuitry elements associated with different aspects of the electronic cigarette's operation. For example, depending on the functionality provided in different implementations, the device control circuitry 28 may comprise power source control circuitry for controlling the supply of electrical power from the power source 14 to the aerosol generator 36, user programming circuitry for establishing configuration settings (e.g. user-defined power settings) in response to user input, as well as other functional units/circuitry associated functionality in accordance with the principles described herein and conventional operating aspects of electronic cigarettes. It will be appreciated the functionality of the device control circuitry 28 can be provided in various different ways, for example using one or more suitably programmed programmable computer(s) and/or one or more suitably configured application-specific integrated circuit(s)/circuitry/chip(s)/chipset(s) configured to provide the desired functionality.

The aerosol provision device 20 includes one or more air inlets 21. In use, as a user inhales on the mouthpiece 35, air is drawn into the aerosol provision device 20 through the air inlets 21 and along an air channel 23 to the aerosol generator 36, where the air mixes with the vaporised aerosol-generating material 32 and forms a condensation aerosol. The air drawn through the aerosol generator 36 continues along the air channel 23 to a mouthpiece 35, carrying some of the aerosol with it, and out through the mouthpiece 35 for inhalation by the user. Alternatively, the one or more air inlets 21 may be included on the article 30, such that the air channel 23 is entirely contained within the article 30.

By way of a concrete example, the article 30 comprises a housing (formed, e.g., from a plastics material), an aerosol-generating material storage area 39 formed within the housing for containing the aerosol-generating material 32 (which in this example may be a liquid which may or may not contain nicotine), an aerosol-generating material transfer component 37 (which in this example is a wick formed of e.g., glass or cotton fibres, or a ceramic material configured to transport the liquid from the reservoir using capillary action), an aerosol-generating area containing the aerosol generator 36, and a mouthpiece 35. Although not shown, a filter and/or aerosol modifying agent (such as a flavour imparting material) may be located in, or in proximity to, the mouthpiece 35. The aerosol generator 36 of this example comprises a heater element formed from an electrically resistive material (such as NiCr8020) spirally wrapped around the aerosol-generating material transfer component 37, and located in the air channel 23. The area around the heating element and wick combination is the aerosol-generating area of the article 30.

Figure 2:
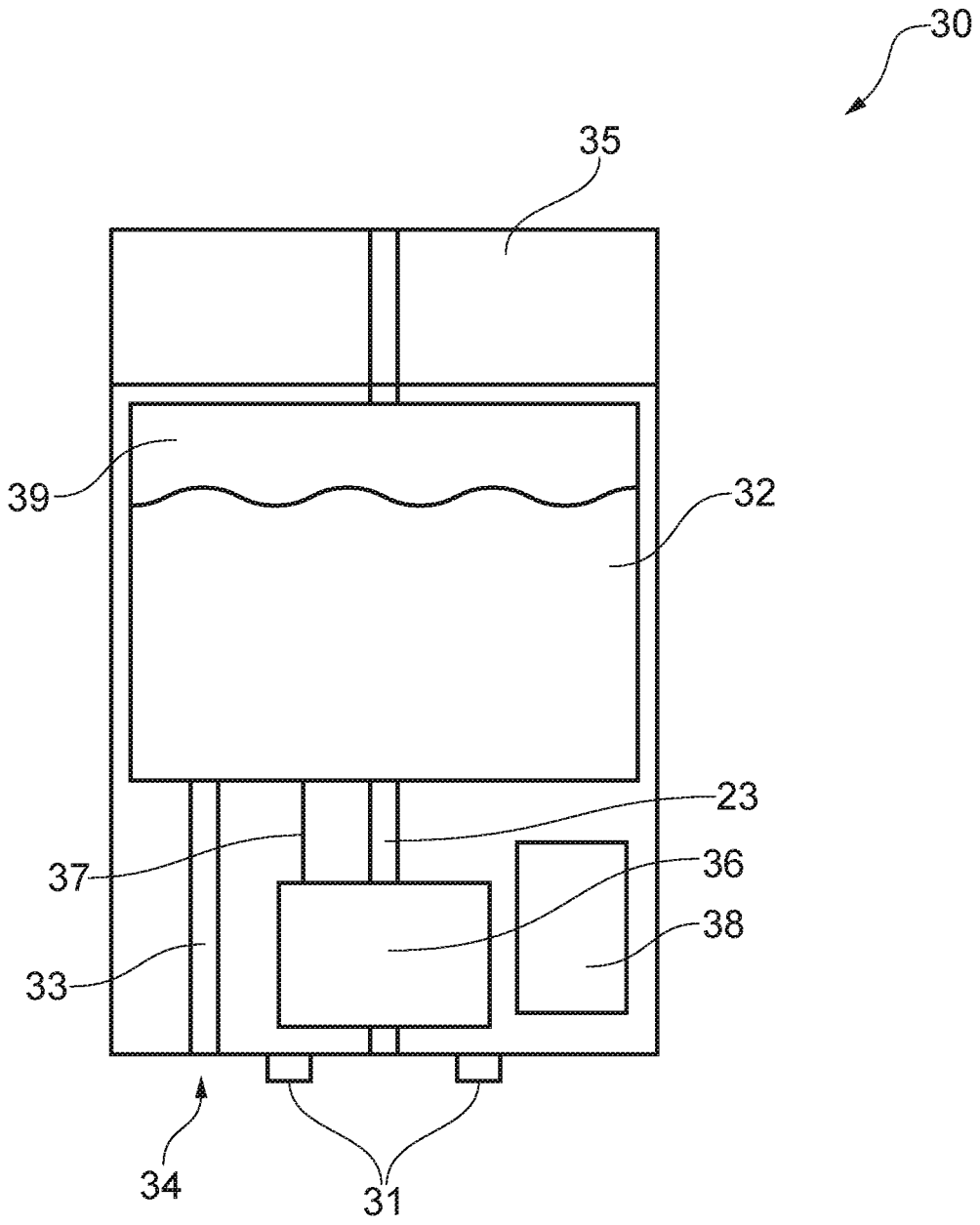
FIG. 2 is a schematic diagram of an example article for use in the aerosol provision system illustrated in FIG. 1.

FIG. 2 is a schematic diagram of an example article 30 for use in the aerosol provision system 10 illustrated in FIG. 1, where the same reference signs have been used for like elements between the article 30 illustrated in FIG. 1 and the article 30 illustrated in FIG. 2. As per the article 30 illustrated in FIG. 1, the article 30 illustrated in FIG. 2 includes an aerosol-generating material storage area 39 for storing an aerosol-generating material 32, an aerosol-generating material transfer component 37, an aerosol generation area containing an aerosol generator 36, and a mouthpiece 35.

The article 30 illustrated in FIG. 2 is configured to be refilled and reused. In other words, the aerosol-generating material storage area 39 of the article 30 illustrated in FIG. 2 can be refilled with aerosol-generating material 32 once some or all of the aerosol-generating material 32 contained in the aerosol-generating material storage area 39 has been exhausted or depleted. To facilitate the refilling or replenishment of aerosol-generating material 32, the article 30 has a refilling tube 33 extending between the aerosol-generating material storage area 39 and the exterior or an outer surface of the housing of the article 30, thereby creating a refilling orifice 34. Aerosol-generating material 32 can then be inserted into the aerosol-generating material storage area 39 via the refilling orifice 34 and refilling tube 33. It will be appreciated, however, that such a configuration of a refilling tube 33 and a refilling orifice 34 is not essential, and the article 30 may comprise any other suitable means of facilitating the refilling of the aerosol-generating material storage area 39 with aerosol generating material 32.

The refilling orifice 34 and/or the refilling tube 33 may be sealable, for example with a cap or one-way valve, in order to ensure that aerosol-generating material 32 does not leak out of the refilling orifice 34. Although the refilling orifice 34 is illustrated in FIG. 2 as being on the same end or surface of the article 30 as the air channel 23 and interface with the aerosol provision device 20, this is not essential. The refilling orifice 34 may be located at the end of the article 30 comprising the mouthpiece 35, for example proximate to the outlet of the air channel 23 on the mouthpiece 35, such that the refilling tube 33 extends between the end of the article 30 comprising the mouthpiece 35 and the aerosol-generating material storage area 39. In this case, the article 30 does not necessarily need to be separated from the aerosol-generating device 20 in order to refill the article 30 with aerosol-generating material 32, as the refilling orifice 34 is not obstructed by the aerosol-generating device 20 when the article 30 is coupled with the aerosol provision device 20.

The article 30 illustrated in FIG. 2 also comprises article control circuitry 38 configured to control the operation of the article 30 and store parameters and/or data associated with the article 30. The parameters associated with the article 30 may include, for example, a serial number and/or stock keeping unit (SKU) for the article 30 or other means of identifying the article 30 and/or the type of the article 30, a date of manufacture and/or expiry of the article 30, an indication of the number of times the article 30 has been refilled, the capacity of the aerosol-generating material storage area 39 and/or the amount of aerosol-generating material remaining in the aerosol-generating material storage area 39. As described above in relation to the device control circuitry 28, the article control circuitry 38 can be provided in various different ways, for example using one or more suitably programmed programmable computer(s) and/or one or more suitably configured application-specific integrated circuit(s)/circuitry/chip(s)/chipset(s) configured to provide the desired functionality. For example, the article control circuitry 38 may comprise a microcontroller unit (MCU) or a system on chip (SoC).

The article 30 illustrated in FIG. 2 also comprises one or more connectors 31, such as contact electrodes, connected via electrical wiring to the aerosol generator 36 and the article control circuitry 38. In use, the article 30 is coupled to the aerosol-generating device 20 and the connectors 31 mate with connectors on the aerosol-generating device, thereby allowing electrical power and electrical current to be supplied from the battery 14 of the aerosol-generating device 20 to the aerosol generator 36 and the article control circuitry 38.

Figure 3:
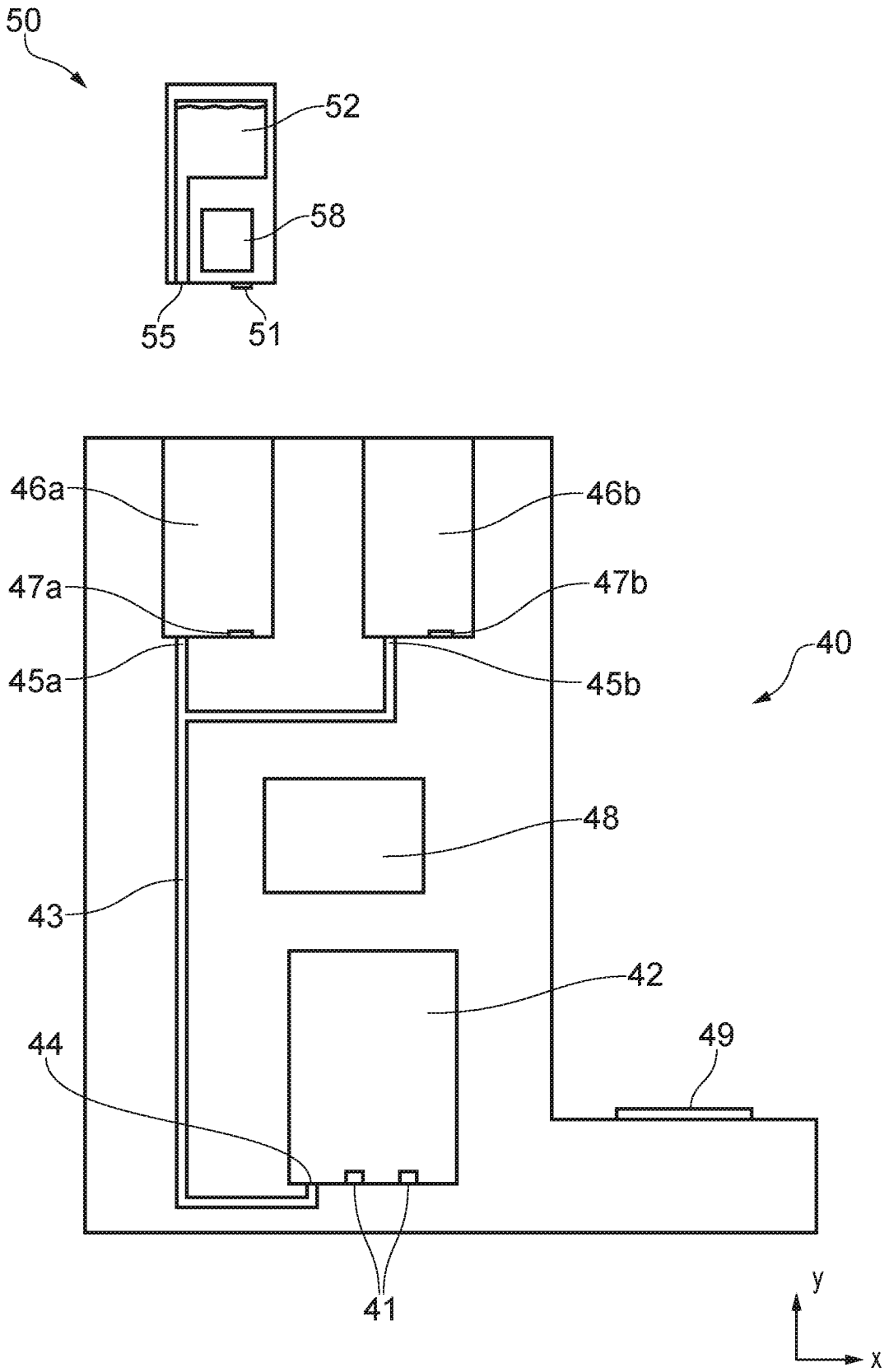
FIG. 3 is a schematic diagram of an example refilling device and a reservoir for refilling the article illustrated in FIG. 2.

FIG. 3 is a schematic diagram of a refilling device 40 for an article of an aerosol provision system, such as the article 30 illustrated in FIG. 2, and a reservoir 50. The reservoir 50 is a disposable/replaceable part which contains aerosol-generating material 52. The refilling device 40 facilitates the transfer of the aerosol-generating material 52 from the reservoir 50 to the article 30 in order to refill or replenish the aerosol-generating material storage area 39 of the article 30 with aerosol-generating material. The article 30 can then be reused as part of the aerosol provision system 10 described above, whilst the reservoir 50 can be disposed of when the aerosol-generating material 52 within the reservoir 50 has been depleted. This allows a single article 30 to be refilled using multiple reservoirs, thereby increasing the number of uses of a single article 30.

The refilling device 40 comprises an article interface 42 configured to receive the article 30. The article interface 42 may comprise a slot, tray, opening or aperture on the refilling device 40 into or onto which the article 30 is placed or coupled. Alternatively the article interface 42 may comprise a lead or other cable which is attachable or otherwise connectable to the article 30. Although one article interface 42 is illustrated in FIG. 3, the refilling device 40 may comprise more than one article interface 42, for example three, five or ten, depending on the specific design of the refilling device 40. In this case, two or more of the article interfaces 42 may be different such that the refilling device 40 is capable of receiving different types of article, or two or more of the article interfaces 42 may be the same such that the refilling device 40 is capable of receiving multiple articles of the same type.

The refilling device 40 also comprises one or more reservoir interfaces 46 configured to receive a reservoir 50. In the same fashion as described above in relation to the article interface 42, each of the reservoir interfaces 46 may comprise a slot, tray, opening or aperture on the refilling device 40 into or onto which the reservoir 50 is placed or coupled. Alternatively, each reservoir interface 46 may comprise a lead or other cable which is attachable or otherwise connectable to the reservoir 50. Although two reservoir interfaces 46 are illustrated in FIG. 3, this is not essential and the refilling device 40 may comprise fewer or more reservoir interfaces 46, for example one, three, five or ten, depending on the specific design of the refilling device 40.

The refilling device 40 also comprises refilling control circuitry 48 configured to control the operation of the refilling device 40, also referred to herein as control circuitry 48. As described above in relation to the device control circuitry 28, the refilling control circuitry 48 can be provided in various different ways, for example using one or more suitably programmed programmable computer(s) and/or one or more suitably configured application-specific integrated circuit(s)/circuitry/chip(s)/chipset(s) configured to provide the desired functionality. For example, the refilling control circuitry 48 may comprise a microcontroller unit (MCU) or a system on chip (SoC).

Although not illustrated, the refilling device 40 may also comprise a power source, such as a battery, configured to supply electrical power to the components of the refilling device 40. Alternatively, the power source may be an external power supply, such as a mains electricity supply or an external battery pack, to which the refilling device 40 can be coupled, attached or otherwise connected.

As described above, the reservoir 50 comprises aerosol-generating material 52 for transferring, by the refilling device 40, to the article 30 in order to refill or replenish the aerosol-generating material 32 in the aerosol-generating material storage area 39 of the article 30.

The reservoir 50 illustrated in FIG. 3 also comprises reservoir control circuitry 58 configured to control the reservoir 50 and store parameters and/or data associated with the reservoir 50. The parameters associated with the reservoir 50 may include, for example data indicative of an amount of aerosol-generating material 52 stored in the reservoir 50, data relating to the aerosol-generating material 52 stored in the reservoir 50, such as one or more ingredients, the concentration and/or amount of the ingredients and/or one or more flavourants within the aerosol-generating material 52. The data may also comprise an identifier, such as a serial number and/or SKU for the reservoir 50 or other means of identifying the reservoir 50 and/or the type of the reservoir 50, and a date of manufacture and/or expiry of the reservoir 50. As described above in relation to the device control circuitry 28, the reservoir control circuitry 58 can be provided in various different ways, for example using one or more suitably programmed programmable computer(s) and/or one or more suitably configured application-specific integrated circuit(s)/circuitry/chip(s)/chipset(s) configured to provide the desired functionality. For example, the reservoir control circuitry 58 may comprise a microcontroller unit (MCU) or a system on chip (SoC). Alternatively, the reservoir control circuitry 58 may comprise a code printed onto the reservoir, such as a barcode or QR code, or an NFC chip or other form of passive tag.

The refilling device 40 illustrated in FIG. 3 also comprises one or more connectors 41, such as contact electrodes, connected via electrical wiring to the refilling control circuitry 48 and the power source (not illustrated). The connectors 41 are located proximate to or as part of the article interface 42. This facilitates communication between the refilling control circuitry 48 and the article control circuitry 38; the connectors 31 on the article 30 mate with the connectors 41 on the refilling device 40 when the article 30 is received by the article interface 42, thereby allowing power to be supplied from the refilling device 40 to the article control circuitry 38 and electrical signals to be transferred between the refilling control circuitry 48 and the article control circuitry 38. The connectors 41 may be arranged relative to the article interface 42 in a pattern and position matching/mirroring the connectors 31 on the article 30 in order to facilitate the mating of the connectors 31 on the article 30 and the connectors 41 on the refilling device 40 when the article 30 is received by the article interface 42.

In the same fashion, the refilling device 40 illustrated in FIG. 3 also comprises one or more connectors 47, such as contact electrodes, located proximate to or as part of each of the reservoir interfaces 46 and connected via electrical wiring to the refilling control circuitry 48 and the power source (not illustrated). The connectors 47 mate with the connectors 51 on the reservoir 50 when the reservoir 50 is received by the reservoir interface 46, thereby allowing power to be supplied from the refilling device 40 to the reservoir control circuitry 58 and electrical signals to be transferred between the refilling control circuitry 48 and the reservoir control circuitry 58. The connectors 47 may be arranged relative to the reservoir interface 46 in a pattern and position matching/mirroring the connectors 51 on the reservoir 50 in order to facilitate the mating of the connectors 51 on the reservoir 50 and the connectors 47 on the refilling device 40 when a reservoir 50 is received by one of the reservoir interfaces 46.

Although the connectors 31, 41, 47, 51 are described herein as physical electrical connectors between the article, the refilling device and the reservoir, in an alternative implementation one or more of the electrical connections between the respective components may be a wireless connection, such as NFC, RFID, or inductive coupling.

The refilling device 40 illustrated in FIG. 3 also comprises a refilling outlet 44 located proximate to or as part of the article interface 42, a refilling inlet 45 located proximate to or as part of each of the reservoir interfaces 46, and a duct 43 connecting each refilling inlet 45 to the refilling outlet 44. The refilling outlet 44 is configured to mate with the refilling orifice 34 on the article 30 when the article is received by the article interface 42, and each refilling inlet 45 is configured to mate with a reservoir outlet 55 when a reservoir 50 is received by the corresponding reservoir interface 46. The duct 43 is configured to facilitate the transfer of aerosol-generating material 52 from each of the refilling inlets 45 to the refilling outlet 44, thereby providing a transfer path for aerosol-generating material 52 from the reservoir 50 through the refilling device 40 and into the article 30.

Although the refilling outlet 44 is illustrated in FIG. 3 as being on the same end or surface of the article interface 42 as the connectors 41, this is not essential. The refilling outlet 44 may be located anywhere proximate to or in the article interface 42 relative to the connectors 41 in order for the refilling outlet 44 to mate with the refilling orifice 34 on the article 30 whilst the connectors 41 on the refilling device 40 mate with the connectors 31 on the article 30 when the article 30 is received by the article interface 30. Similarly, the refilling inlet 45 may be located anywhere proximate to or in each reservoir interface 46 relative to the connectors 47 in order for the refilling inlet 45 to mate with the reservoir outlet 55 on the reservoir 50 whilst the connectors 47 on the refilling device 40 mate with the connectors 51 on the reservoir 50 when a reservoir 50 is received by a reservoir interface 46.

Further, as described above, the refilling device 40 may be configured to receive different types, designs or configuration of article 30 using the same article interface 42. In this case, there may be multiple configurations of connectors 41 and/or refilling outlets 44 proximate to or in the article interface 42 in order to facilitate the same article interface 42 receiving different types, designs or configurations of article 30. Equally, there may be multiple configurations of connectors 47 and/or refilling inlets 45 proximate to or in each reservoir interface 46 in order to facilitate the same reservoir interface 46 receiving different types, designs or configurations of reservoir 50. Alternatively or in addition, the configuration of connectors 47 and/or refilling inlets 45 proximate to or in the one or more of the reservoir interfaces 46 may be different such that different reservoir types are received by different reservoir interfaces 46 of the same refilling device 40.

One or more of the refilling outlet 44, the refilling inlets 45, the reservoir outlet 55 and the duct 43 may also include a means of controlling the rate and/or direction of transfer of the aerosol-generating material 52, for example a ball valve, needle valve or diaphragm to control the rate of transfer and/or a one way valve such as a check valve or non-return valve to control the direction of transfer. For example, a one way valve may be located at or proximate to each of the refilling outlet 44, the refilling inlets 45 and the reservoir outlets 55 to ensure that aerosol-generating material 52 can only be transferred from the reservoir 50 to the refilling device 40 and from the refilling device 40 to the article 30, whilst a single ball valve or diaphragm may be located on or in the duct 43 of the refilling device 40 in order to control the flow rate of aerosol-generating material 52 from the reservoir 50 through the refilling device 40 and into the article 30. Equally, a ball valve or diaphragm may be located proximate to each refilling inlet 45 in order to independently control the rate of transfer of aerosol-generating material 52 into each of the refilling inlets 45 or from each of the refilling inlets 45 into the duct 43. For example, this allows the refilling control circuitry 48 to prevent a first aerosol-generating material 52 being transferred from a first reservoir 50 whilst a second aerosol-generating material 52 is being transferred from a second reservoir 50 to the article 30. This also allows the refilling control circuitry 48 to facilitate the transfer the first aerosol-generating material 52 from the first reservoir 50 and the second aerosol-generating material 52 from the second reservoir 50 simultaneously to the article 30, but at different transfer rates, thereby creating an aerosol-generating material 32 in the article 30 containing a mixture of the first aerosol-generating material 52 and the second aerosol-generating material 52 at different concentrations.

The refilling device 40 illustrated in FIG. 3 also optionally comprises a device interface 49 configured to receive the aerosol provision device 20 in order to supply electrical power from the refilling device 40 to the aerosol provision device 20. This electrical power can be used, for example, to recharge the power source or battery 14 of the aerosol provision device 20 and to facilitate the transfer of electrical signals between the refilling control circuitry 48 and the device control circuitry 28. This allows the user to use the refilling device 40 as a means of charging the aerosol provision device 20 whilst the article 30 is being replenished with aerosol-generating material 32, thereby reducing the number of associated devices needed to operate and maintain the aerosol provision system 10. The device interface 49 may be a wired interface, such as using electrical connectors as described above, or a wireless interface such as inductive or capacitive coupling. The device interface 49 may also be configured to the transfer of data between the refilling control circuitry 48 and the device control circuitry 28. The refilling control circuitry 48 may be configured to read data from the aerosol provision device 20 and/or write data to the aerosol provision device 20, for example to perform a software update, thereby installing an updated version of software onto the device control circuitry 28.

As set out above, the refilling device 40 facilitates the transfer of aerosol-generating material 52 from the reservoir 50 to the article 30 in order to refill or replenish the article 30 so that it can be reused as part of the aerosol provision system 10. By way of a concrete example, when a reservoir 50 is received by one of the reservoir interfaces 47, the connectors 47 located proximate to or in the corresponding reservoir interface 46 mate with the connectors 51 on the reservoir 50 and the refilling inlet 45 located proximate to or in the corresponding reservoir interface 46 mates with the reservoir outlet 55. When an article 30 is received by the article interface 42, the connectors 41 located proximate to or in the article interface 42 mate with the connectors 31 on the article 30 and the refilling outlet 45 mates with the refilling orifice 34 on the device 30. The refilling control circuitry 48 is then configured to facilitate the transfer of aerosol-generating material 52 from the reservoir 50 to the article 30 by facilitating the transfer of aerosol-generating material 52 from the reservoir 50 into the duct 42 of the refilling device 40 via the reservoir outlet 51 and the refilling inlet 45, and from the duct 42 of the refilling device 40 into the aerosol-generating material storage area 39 of the article 30 via the refilling outlet 44, the refilling orifice 34 and the refilling tube 33.

In the examples where the refiling device 40 has a plurality of reservoir interfaces 46, the refilling control circuitry 48 is configured to selectively facilitate the transfer of aerosol-generating material 52 from a reservoir 50 received by one of the reservoir interfaces 46, for example in response to a determination that only one of the reservoir interfaces 46 has received a reservoir 50, or in response to a selection of a particular reservoir 50 from which aerosol-generating material 52 should be transferred, for example a user input or a determination based on one or more parameters of each of the reservoirs 50 stored on the respective reservoir control circuitry 58. In this case, the refilling control circuitry 48 is configured to receive, from a user of the refilling device 40, a selection of one or more reservoir interfaces 46 and selectively facilitate the transfer of aerosol-generating material 52, from each reservoir 50 connected to one of the one or more selected reservoir interfaces 46, to the article 30 when the article 30 is coupled to the refilling device. In other words, the refilling control circuitry 48 is configured to only transfer aerosol-generating material 52 from a reservoir 50 connected to a selected reservoir interface 46, and prevent aerosol-generating material 52 from being transferred from any other reservoir 50 connected to the refilling device 40.

Although not illustrated, in some examples, the refilling device 40 can comprise a tank, container or other such receptacle for storing aerosol-generating material 52 received from the reservoir 50, for example when a reservoir 50 is received by the reservoir interface 46 without an article 30 being received by the article interface 42, thereby allowing the reservoir 50 to be disconnected from the reservoir interface 46 before an article 30 is received by the article interface 42. In this case, the aerosol-generating material 52 is stored in the receptacle of the refilling device 40 until such a time that it can be transferred to an article 30 received by the article interface 42. In this case, control circuitry 48 of the refilling device 40 is configured to facilitate the transfer of aerosol-generating material 52 from the reservoir 50 to the receptacle, and subsequently and separately to facilitate the transfer of the aerosol-generating material 52 from the receptacle to the article 42.

The receptacle of the refilling device 40 can also be used to facilitate the mixing of aerosol-generating material 52 before it is transferred to the article 30. For example, if a first reservoir interface 46 receives a first reservoir 50 containing a first aerosol-generating material 52 and a second reservoir interface 46 receives a second reservoir 50 containing a second aerosol-generating material 52, then the refilling control circuitry 48 can be configured to facilitate the transfer of the first aerosol-generating material 52 from the first reservoir 50 into the receptacle, and facilitate the transfer of the second aerosol-generating material 52 from the second reservoir 50 into the receptacle. The first aerosol-generating material 52 and the second aerosol-generating material 52 can then be mixed in the receptacle, and the mixture of the first aerosol-generating material 52 and the second aerosol-generating material 52 transferred to the article 30.

Figure 4:
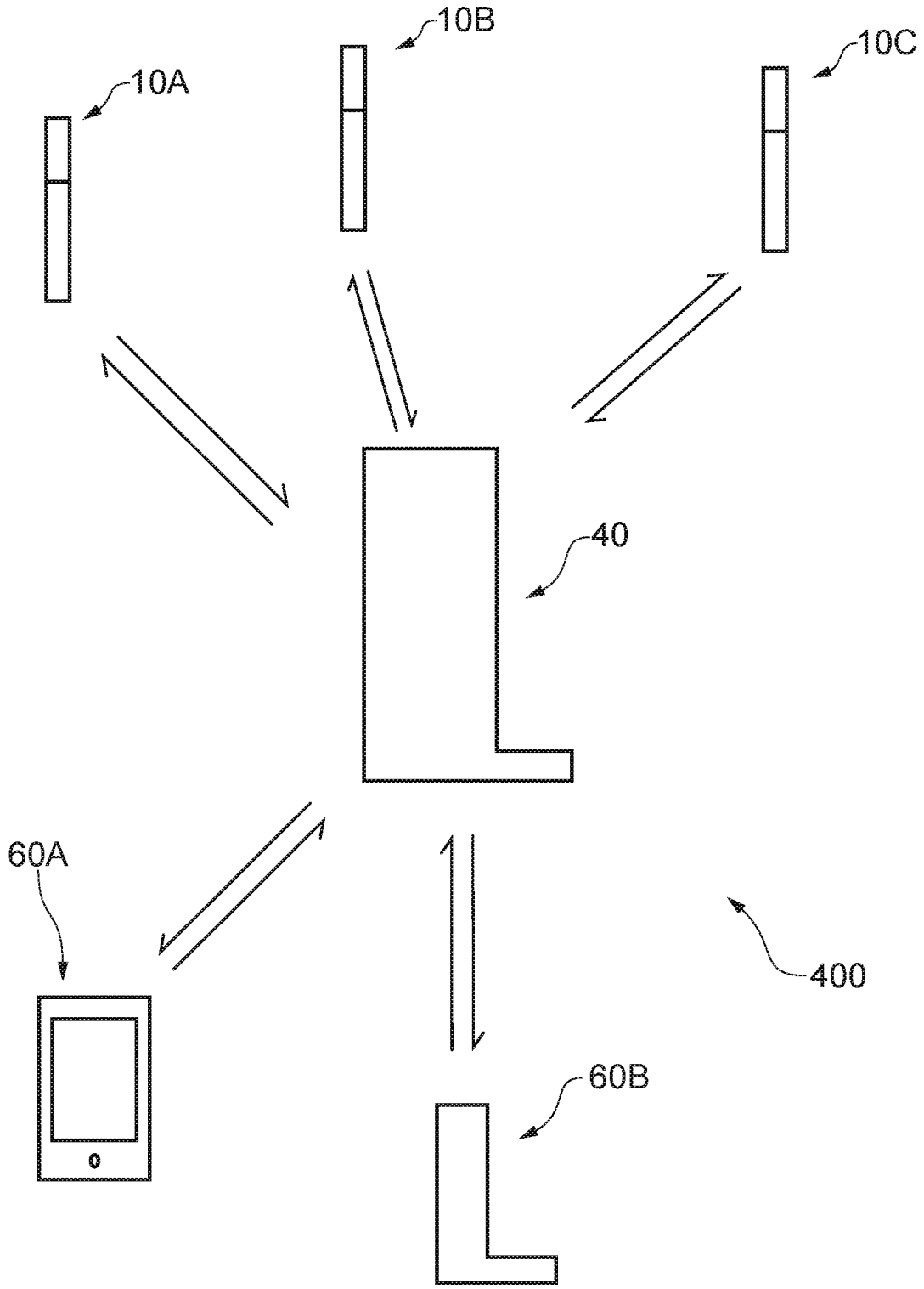
FIG. 4 is a schematic diagram of a system including the refilling device.

FIG. 4 illustrates a system 400 comprising the refilling device 40 which is connectively couple to one or more aerosol provision systems 10A-10C and one or more connected (external) devices 60A-60B. It is to be understood that the term "connected device" means a device in communication with the refilling device 40, and need not require the connected device to be physically connected to the refilling device 40. In other words, the connected devices 60A-60B are external devices such that they are external to the refilling device 40. The connected devices 60A-60B may include any suitable electronic device that can be communicatively coupled to the refilling device 40. For example, a connected device may include a mobile device 60A (such as a smartphone), a PDA, a personal computer, laptop, tablet, smartwatch, or another refilling device 60B. The refilling device 40 comprises a communications interface, and the refilling control circuitry 48 is configured to communicate with the one or more aerosol provision systems 10A-10C and one or more connected devices 60A-60B in the system 400 via the communications interface. The communications interface can be configured to use a wireless communication protocol, such as Wi-Fi, Bluetooth, or using a cellular network. The communication means used between the refilling device 40 and the aerosol provision systems 10A-10C may be the same or may be different to the communication means used between the refilling device 40 and connected devices 60A-60B. For example, the refilling device retailer was 40 may use Bluetooth to communicate with each of the aerosol provision systems 10A-10C, whilst the refilling device 40 may use Wi-Fi to communicate with each of the connected devices 60A-60B. Alternatively, the communication means used between the refilling device 40 and each of the aerosol provision systems 10A-10C may be different, and the communication means used between the refilling device 40 and each of the connected devices 60A-60B may be different.

The refilling device 40 is configured to use the other devices in the system 400 to determine a location of a lost aerosol provision system.

The refilling control circuitry 48 is configured to receive a request to locate a lost aerosol provision system. The request to locate the lost aerosol provision system may be received from an external device, such as one of the connected devices 60A-60B, via the communications interface. For example, the request may be received from a mobile device 60A via the communications interface using Bluetooth or from another refilling device 60B via communications interface using Wi-Fi. Alternatively, the request aerosol provision system may be received as an input on the refilling device 40. For example, the user can provide a user input on an input device of the refilling device 40, such as a button, switch or touchscreen display of the refilling device 40. In other words, the request to locate the lost aerosol provision system is received by the input device of the refilling device 40.

In response to receiving the request to locate the lost aerosol provision system, the refilling control circuit 48 is configured to determine an identifier for the lost aerosol provision system. Each aerosol provision system 10A-10C can have a unique identifier that can be used to distinguish or otherwise identify a particular aerosol provision system from other aerosol provision systems. The request to locate the lost aerosol provision system may comprise the identifier of the lost aerosol provision system, such that the refilling control circuitry 48 is able to determine the identifier for the lost aerosol provision system by reading it from the received request. Alternatively or in addition, the aerosol provision system 10 can be associated with the user account, and the refilling control circuitry 48 can be configured to determine the identifier for the lost aerosol provision system based on information associated with a user account. For example, the request to locate the lost aerosol provision system may comprise a means of identifying the user account, such as a username, email address associated with the user account, and/or identifier for the user account. The lost aerosol provision system 10, and in some cases the refilling device 40, can each be associated with the user account such that, having identified the user account, the identifier for the lost aerosol provision system 10 can be determined. The information associated with the user account may be stored locally on the refilling device 40 and/or stored on a remote server. In the latter example, in response to receiving the request to locate the lost aerosol provision system 10, the refilling control circuitry 48 can be configured to send the means of identifying the user account to the remote server via the communications interface. The remote server can then look up the user account or otherwise determine the identifier of the lost aerosol system 10 using the means of identifying the user account, and send the identifier for the lost aerosol provision system to the refilling device 40 (i.e. to the refilling control circuitry 48 via the communications interface).

The refilling control circuitry 48 is then configured to broadcast, via the communications interface, an identification request. In other words, an identification request is sent via the communications interface to any and all devices within broadcast of the refilling device 40. Broadcasting the identification request may occur concurrently with the determination of the identifier for the lost aerosol provision system, or the identification request may be broadcast in response to determining the identifier for the lost aerosol provision system. The refilling control circuit 48 can broadcast multiple identification requests using different communication protocols, for example one identification request using Bluetooth and another using Wi-Fi.

A response to the identification request(s) is then received from any devices within broadcast range of the refilling device 40. In particular, the refilling control circuitry 48 is configured to receive, from one or more aerosol provision systems 10A-10C by the communications interface, a response comprising an identifier for the aerosol provision system. In other words, each aerosol provision system 10A-10C that received the identification request from the refilling device 40 is configured to send a response comprising the identifier for that aerosol provision system. As set out above, the refilling device 40 may communicate with the one or more aerosol provision systems 10A-10C using a different communications protocol to the communications protocol used to communicate with the connected devices 60A-60B. In this case, the identification request is only broadcast using the communications protocol(s) used to communicate with the one or more aerosol provision systems 10A-10C.

The refilling control circuitry 48 is then configured to determine, by comparing the received identifiers to the identifier for the lost aerosol provision system, whether the lost aerosol provision system is within a broadcast range of the refilling device. As set out above, a response is received from each aerosol provision system that is within broadcast range of the refilling device 40 (i.e. from each aerosol provision system that received the identification request broadcast by the refilling device 40). Since each response comprises the identifier for that aerosol provision system, if the lost aerosol provision system is within the broadcast range of the refilling device 40, then the determined identifier for the lost aerosol provision system will match an identifier received in a response. Equally, if the determined identifier for the lost aerosol provision system does not match an identifier received in a response, the last aerosol provision system is not within the broadcast range of the refilling device 40.

Having determined whether the lost aerosol provision system is within the broadcast range of the refilling device 40, the refilling control circuitry 48 can be configured to send, via the communications interface, to an external device, for example the external device from which the request to locate a lost aerosol provision system was received, an indication of whether the lost aerosol provision system is within a broadcast range of the refilling device. Alternatively or in addition, the refilling device 40 can comprise an output device configured to output an indication of whether the lost aerosol provision system is within a broadcast range of the refilling device. The output device can comprise a speaker configured player sound, one or more LEDs or a display screen. The user of the refilling device 40 can then use the output indication to find the lost aerosol provision system. For example, if the indication indicates that the lost aerosol provision system is within the broadcast range of the refilling device 40, the user is able to narrow their search for the lost aerosol provision system to an area around the refilling device 40. Otherwise, if the indication indicates that the lost aerosol provision system is not within the broadcast range of the refilling device 40, the user knows that the lost aerosol provision system is in a different location or area away from the refilling device 40.

The refilling control circuitry 48 can then be configured to determine, based on whether the lost aerosol provision system is within the broadcast range of the refilling device 40, a location of the lost aerosol provision system. For example, the refilling control circuitry 48 can use the signal strength or other property of the connection between the communications interface and the lost aerosol provision system to determine a distance from the refilling device 40 to the lost aerosol provision system. Alternatively or in addition, the refilling control circuitry 48 can be configured to send to the lost aerosol provision system, via the communications interface, a request for location information. In response to the request, the lost aerosol provision system can determine its location, for example using a GPS interface, by cellular triangulation, or using a Wi-Fi positioning system. The lost aerosol provision system can then send an indication of its location, which is received by the refilling control circuitry 48 via the communications interface. The refilling control circuitry 48 can then use the indication to determine the location of the lost aerosol provision system. For example, in response to determining that the lost aerosol provision device is within the broadcast range of the refilling device 40, the refilling control circuitry 48 can be configured to determine the location of the lost aerosol provision system as being within a given radius of the refilling device 40, where the radius corresponds to the broadcast range of the refilling device. This radius thereby defines a circle within which the lost aerosol provision system is located.

Having determined the location of the lost aerosol provision system, the refilling control circuitry 48 can be configured to provide an indication of the location of the lost aerosol provision system. This indication may be provided at the same time as the indication of whether the lost aerosol provision system is within the broadcast range of the refilling device 40 as described above, or may be provided separately. For example, if the lost aerosol provision system is within broadcast range of the refilling device 40, the refilling control circuitry 48 may provide the indication of whether the lost aerosol provision system is within the broadcast range of the refilling device 40 before or simultaneously with the indication of the location of the lost aerosol provision system. Alternatively, if the lost aerosol provision system is within broadcast range of the refilling device 40, the refilling control circuitry 48 may only provide an indication of the location of the lost aerosol provision system.

The refilling control circuitry 48 can be configured to send, via the communications interface, to an external device, for example the external device from which the request to locate a lost aerosol provision system was received, an indication of the location of the lost aerosol provision system. Alternatively or in addition, the refilling device 40 can comprise an output device configured to output an indication of the location of the lost aerosol provision system. The output device can comprise a speaker configured player sound, one or more LEDs or a display screen. The user of the refilling device 40 can then use the output indication to find the lost aerosol provision system. For example, the indication of the location of the lost aerosol provision system can be output on the output device of the refilling device 40 if the request to locate a lost aerosol provision system was received from a user via an input device of the refilling device 40.

As set out above, the refilling control circuitry 48 may be configured to communicate with one or more connected devices 60A-60B via the communications interface. The refilling control circuitry 48 can be configured to send, to one or more connected devices 60A-60B via the communications interface, a location request comprising the identifier for the lost aerosol provision system. A response is then received from each of the connected devices via the communications interface. In other words, the refilling control circuitry 48 is configured to receive a response from each of the connected devices 60A-60B via the communications interface. Each response includes an indication whether the lost aerosol provision system is within a broadcast range of that connected device. The refilling control circuitry 48 can then use the indications received from each of the connected devices 60A-60B to determine the location of the lost aerosol provision system. For example, a similar fashion as described above with respect to the lost aerosol provision system, the refilling control circuitry 48 can determine the location of each connected devices 60A-60B which the lost aerosol provision system is within broadcast range of, and used their locations to triangulate, trilaterate or otherwise determine the location of the lost aerosol provision system.

The refilling control circuitry 48 may be configured to send the location requests at the same time or a similar time as the identification request. Alternatively, the location requests may only be sent in response to determining that the lost aerosol provision system is not within broadcast range refilling device 40. Equally, the location requests may only be sent if the location of the lost aerosol provision system cannot be determined by the refilling control circuitry 48, or if the location of the lost aerosol provision system cannot be determined with a given level of accuracy. For example, if the location of the lost aerosol provision system can only be determined within a range of 10, 50, 100, or 500 m then the refilling control circuitry 48 may be configured to send the location requests in order to improve the accuracy of the determined location of the lost aerosol provision system.

In some cases, when the lost aerosol provision system is within the broadcast range of a connected device, that connected device is configured to send location information to the refilling control circuitry 48. In other words, the refilling control circuitry 48 is configured to receive, from one or more of the connected devices via the communications interface, location information when the lost aerosol provision system is within the broadcast range of the connected device. Location information is only received from a given connected device when the lost aerosol provision system is where then the broadcast range of that connected device. The refilling control circuitry 48 can then use the location information received from the one or more connected devices 60A-60B to determine the location of the lost aerosol provision system. For example, the location information may comprise the location of the connected device and the distance to the lost aerosol provision system from the connected device which can then be used by the refilling control circuitry 48 to determine the location of the last aerosol provision system.

As set out above, one or more of the connected devices may comprise another refilling device 60B. It will therefore be appreciated that the refilling device 40 can be configured to receive location requests from other refilling devices, or any other connected (external) device 60A-60B. In this case, the refilling control circuitry 48 is configured to receive, via the communications interface, a location request to locate a lost aerosol provision system from a connected device 60A-60B. As set out above, the request comprises an identifier for the lost aerosol provision system.

In a similar fashion to as described above, the refilling control circuitry 48 is then configured to broadcast, via the communications interface, an identification request. A response to the identification request(s) is then received from any devices within broadcast range of the refilling device 40. In particular, the refilling control circuitry 48 is configured to receive, from one or more aerosol provision systems 10A-10C by the communications interface, a response comprising an identifier for the aerosol provision system. In other words, each aerosol provision system 10A-10C that received the identification request from the refilling device 40 is configured to send a response comprising the identifier for that aerosol provision system.

The refilling control circuitry 48 is then configured to determine, by comparing the received identifiers to the identifier for the lost aerosol provision system, whether the lost aerosol provision system is within a broadcast range of the refilling device. The refilling control circuitry 48 is then configured to send, to the connected device via the communications interface, an indication whether the lost aerosol provision system is within the broadcast range of the refilling device based on the determining. In other words, the refilling control circuitry 48 sends a response to request from the connected device, where the response comprises an indication whether the lost aerosol provision system is within the broadcast range of the refilling device 40 based on the determining.

The refilling control circuitry 48 can also be configured to send, to the connected device via the communications interface, location information if the lost aerosol provision system is within the broadcast range of the refilling device. For example, the refilling control circuitry 48 can determine the location information in response to determining that the lost aerosol provision system is within the broadcast range of the refilling device 40 as described above. The location information may be contained in the same response as the indication whether the lost aerosol provision system is within the broadcast range of the refilling device 40, or in a separate communication/message. As set out above, the location information may comprise the location of the connected device and the distance to the lost aerosol provision system from the connected device. In this case, the refilling device 40 can determine its own location using a GPS interface of the refilling device 40, or based on the signal strength of the connections between the one or more aerosol provision systems 10A-10C and the one or more connected devices 60A-60B.

It will therefore be appreciated, that the refilling device 40 can be used as part of a network, grid or mesh of connected devices 60A-60B such that, in response to a request to locate a lost aerosol provision system being received at any of the connected devices, the connected devices 60A-60B can communicate and cooperate in order to locate the lost aerosol provision system.

Figure 5:
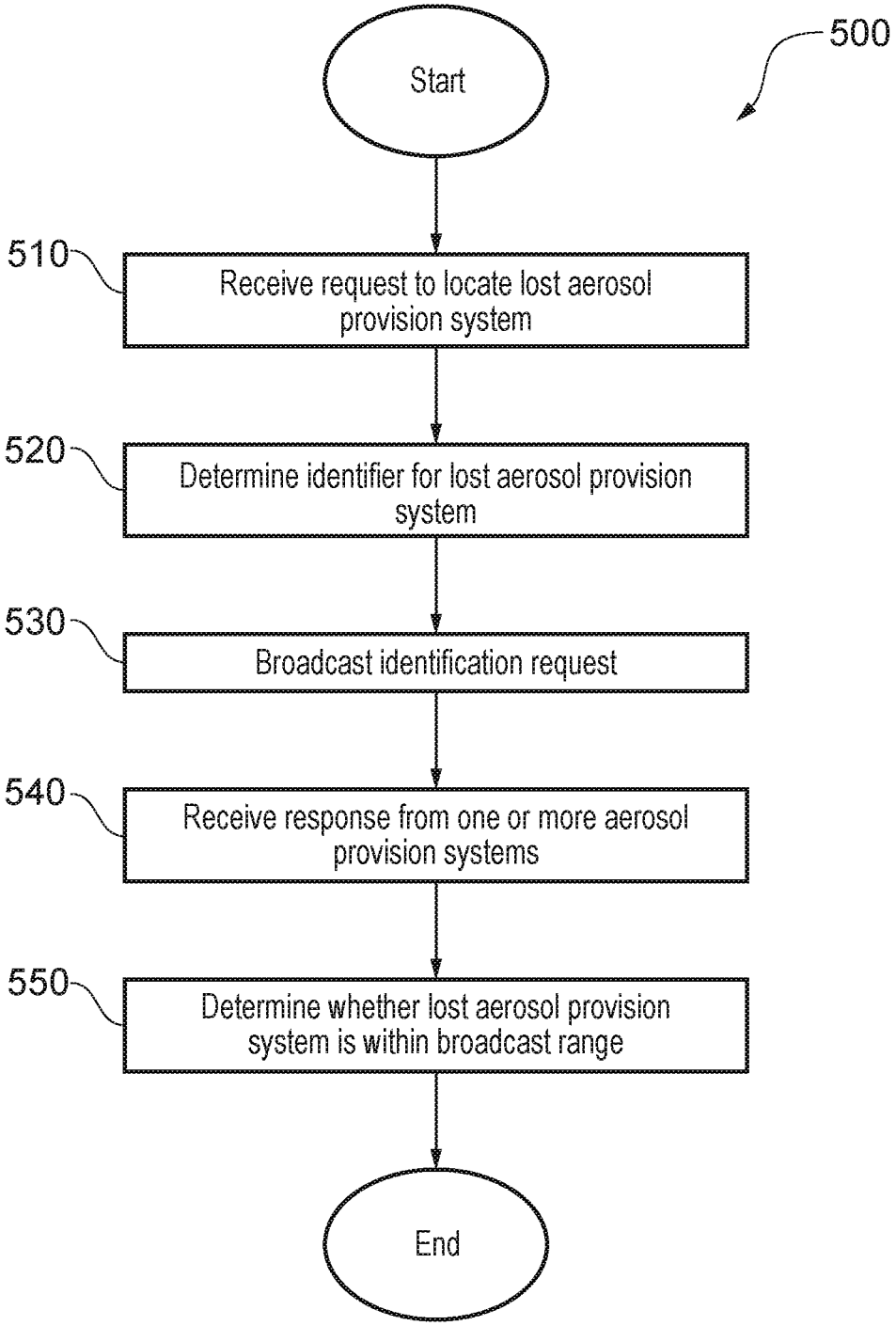
FIG. 5 is a flow chart of a method of locating an aerosol provision system.

FIG. 5 is a flow chart of a method 500 of locating an aerosol provision system 10, for example performed by the refilling control circuitry 48. The method begins at step 510, where a request to locate a lost aerosol provision system is received. At step 520, an identifier for the lost aerosol provision system is determined. At step 530, an identification request is broadcast. At step 540, a response is received from one or more aerosol provision systems. The response comprises an identifier for the aerosol provision system. At step 550, it is determined whether the lost aerosol provision system is within a broadcast range by comparing the received identifiers to the identifier for the lost aerosol provision system. The method then ends.

Figure 6:
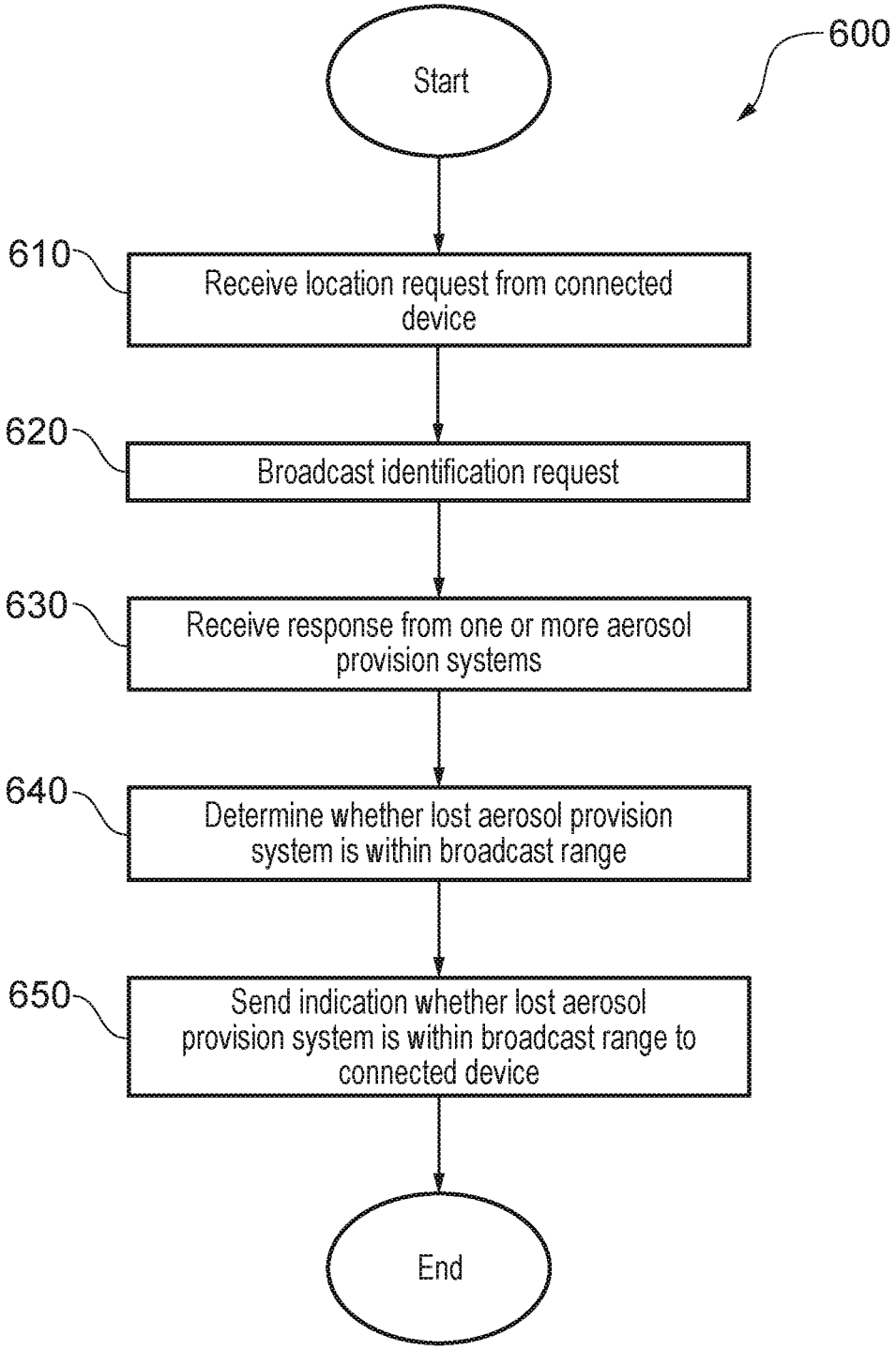
FIG. 6 is a flow chart of a method of locating an aerosol provision system.

FIG. 6 is a flow chart of a further method 600 of locating an aerosol provision system 10, for example performed by the refilling control circuitry 48. The method begins at step 610, where a location request to locate a lost aerosol provision system 10 is received from a connected device. The request comprising an identifier for the lost aerosol provision system 10. At step 620, an identification request is broadcast. At step 630, a response is received from one or more aerosol provision systems. The response comprises an identifier for the aerosol provision system. At step 640, it is determined whether the lost aerosol provision system is within a broadcast range by comparing the received identifiers to the identifier for the lost aerosol provision system 10. At step 650, an indication whether the lost aerosol provision system is within the broadcast range is sent to the connected device based on the determining. The method then ends.

The methods 500, 600 illustrated in FIGS. 5 and 6 may be stored as instructions on a computer readable storage medium, such that when the instructions are executed by a processor, the methods 500, 600 described above are performed. The computer readable storage medium may be non-transitory.

As described above, the present disclosure relates to (but it not limited to) a refilling device 40 for an article 30 of an aerosol provision system 10. The refilling device 40 comprises a communications interface and control circuitry 48. The control circuitry is configured to receive a request to locate a lost aerosol provision system, determine an identifier for the lost aerosol provision system, broadcast, via the communications interface, an identification request, receive, from one or more aerosol provision systems via the communications interface, a response comprising an identifier for the aerosol provision system, and determine, by comparing the received identifiers to the identifier for the lost aerosol provision system, whether the lost aerosol provision system is within a broadcast range of the refilling device.

Thus, there has been described a refilling device for an article of an aerosol provision system and a method of locating an aerosol provision system.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A refilling device for an article of an aerosol provision system comprising:

a communications interface; and control circuitry configured to:

receive a request to locate a lost aerosol provision system;

determine an identifier for the lost aerosol provision system;

broadcast, via the communications interface, an identification request;

receive, from one or more aerosol provision systems via the communications interface, a response comprising an identifier for the aerosol provision system; and determine, by comparing the received identifiers to the identifier for the lost aerosol provision system, whether the lost aerosol provision system is within a broadcast range of the refilling device.

2. The refilling device of claim 1, where in the control circuitry is further configured to determine, based on whether the lost aerosol provision system is within the broadcast range of the refilling device, a location of the lost aerosol provision system.

3. The refilling device of claim 2, wherein the control circuitry is further configured to:

send, to one or more connected devices via the communications interface, a location request comprising the identifier for the lost aerosol provision system; and receive, from each of the connected devices via the communications interface, an indication whether the lost aerosol provision system is within a broadcast range of the connected device, wherein determining the location of the lost aerosol provision system is further based on the indications received from each of the connected devices.

4. The refilling device of claim 3, wherein the control circuitry is further configured to:

receive, from one or more of the connected devices via the communications interface, location information when the lost aerosol provision system is within the broadcast range of the connected device, the location information comprising the location of the connected device and a distance to the lost aerosol provision system; and wherein determining the location of the lost aerosol provision system is further based on the location information.

5. The refilling device of claim 3, wherein at least one of the connected devices is another refilling device.

6. The refilling device of claim 1, wherein the request to locate the lost aerosol provision system is received from an external device via the communications interface.

7. The refilling device of claim 6, wherein the request to locate the lost aerosol provision system is received using Bluetooth.

8. The refilling device of claim 6, wherein the control circuitry is further configured to send, to the external device via the communications interface, an indication of whether the lost aerosol provision system is within a broadcast range of the refilling device.

9. The refilling device of claim 1, further comprising an input device and wherein the request to locate the lost aerosol provision system is received via the input device.

10. The refilling device of claim 1, further comprising an output device configured to output an indication of the location of the lost aerosol provision system.

11. The refilling device of claim 1, wherein the request to locate the lost aerosol provision system comprises the identifier of the lost aerosol provision system.

12. The refilling device of claim 1, wherein the aerosol provision system is associated with a user account, and the control circuitry is configured to determine the identifier of the lost aerosol provision system based on information associated with the user account.

13. A refilling device for an article of an aerosol provision system comprising:

a communications interface; and control circuitry configured to:

receive, via the communications interface, a location request to locate a lost aerosol provision system from a connected device, the request comprising an identifier for the lost aerosol provision system;

broadcast, via the communications interface, an identification request;

receive, from one or more aerosol provision systems via the communications interface, a response comprising an identifier for the aerosol provision system;

determine, by comparing the received identifiers to the identifier for the lost aerosol provision system, whether the lost aerosol provision system is within the broadcast range of the refilling device; and send, to the connected device via the communications interface, an indication whether the lost aerosol provision system is within the broadcast range of the refilling device based on the determining.

14. The refilling device of claim 11, wherein the control circuitry is further configured to send, to the connected device via the communications interface, location information if the lost aerosol provision system is within the broadcast range of the refilling device.

15. The refilling device of claim 12, wherein the control circuitry is further configured determine a distance to the lost aerosol provision system based on the response received from the lost aerosol provision system, and wherein the location information comprises a location of the refilling device and the distance to the lost aerosol provision system.

16. A method of locating an aerosol provision system comprising:

receiving, at a refilling device for an article of the aerosol provision system, a request to locate a lost aerosol provision system;

determining, at the refilling device, an identifier for the lost aerosol provision system;

broadcasting, via a communications interface of the refilling device, an identification request;

receiving, at the refilling device, from one or more aerosol provision systems, a response comprising an identifier for the aerosol provision system; and determining, at the refilling device, by comparing the received identifiers to the identifier for the lost aerosol provision system, whether the lost aerosol provision system is within a broadcast range.

* * * * *